US007594294B2

(12) United States Patent
Billig et al.

(10) Patent No.: US 7,594,294 B2
(45) Date of Patent: Sep. 29, 2009

(54) CLEANING IMPLEMENT

(75) Inventors: Jason C. Billig, Mount Vernon, NY (US); Stuart M. Leslie, Larchmont, NY (US); Steven A. Zach, Racine, WI (US); Jose de Jesus Castillo Higareda, Racine, WI (US); Loretta G. Lynch, Racine, WI (US); Jacqueline V. Lepow, Franklin, WI (US); Charles A. Curtiss, Norwalk, CT (US); David Mallard, Somerville, MA (US)

(73) Assignee: S.C. Johnson & Son, Inc., Racine, WI (US)

( * ) Notice: Subject to any disclaimer, the term of this patent is extended or adjusted under 35 U.S.C. 154(b) by 27 days.

(21) Appl. No.: 11/689,696

(22) Filed: Mar. 22, 2007

(65) Prior Publication Data

US 2008/0289128 A1 Nov. 27, 2008

Related U.S. Application Data

(60) Provisional application No. 60/784,540, filed on Mar. 22, 2006, provisional application No. 60/844,868, filed on Sep. 15, 2006.

(51) Int. Cl.
*A47L 13/11* (2006.01)
*A47L 13/12* (2006.01)

(52) U.S. Cl. ..... 15/121; 15/220.1; 15/245

(58) Field of Classification Search ..... 15/121, 15/245, 220.1, 240.1
See application file for complete search history.

(56) References Cited

U.S. PATENT DOCUMENTS

| | | | | |
|---|---|---|---|---|
| 1,376,195 | A | 4/1921 | Fernandez | |
| 2,722,701 | A | 11/1955 | Blum et al. | |
| 2,842,789 | A * | 7/1958 | Wells | 15/121 |
| 3,656,202 | A * | 4/1972 | Paton | 15/121 |
| 4,893,370 | A * | 1/1990 | Klotz | 15/121 |
| 5,092,699 | A | 3/1992 | Silvenis | |
| 5,692,261 | A | 12/1997 | Lops | |
| 5,864,913 | A | 2/1999 | Robertson et al. | |
| 5,970,560 | A | 10/1999 | Leroux | |
| D417,934 | S * | 12/1999 | Footer et al. | D32/42 |
| 6,058,548 | A * | 5/2000 | Footer et al. | 15/119.2 |
| 6,092,255 | A * | 7/2000 | Kim | 15/121 |
| 6,668,418 | B2 * | 12/2003 | Bastien | 15/245 |

(Continued)

FOREIGN PATENT DOCUMENTS

| | | | |
|---|---|---|---|
| DE | 481144 | C | 8/1929 |

(Continued)

OTHER PUBLICATIONS

International Search Report and Written Opinion dated Sep. 5, 2007, Appl. No. PCT/US2007/007103 (J-4570A).

*Primary Examiner*—Shay L Karls

(57) ABSTRACT

A cleaning implement is disclosed which is of the all-in-one type. It has a substrate structure that delivers impregnated cleaning liquid to the window being cleaned, a squeegee to drive used cleaning liquid off the window, and an absorbent to collect the used liquid. A single block of substrate structure can provide the applicator, scrubbing, and collecting functions, as well as filter and reprocess used cleaning liquid for further use. The substrate may be replaced separately from the squeegee, or may be replaced as a unit with the squeegee.

9 Claims, 5 Drawing Sheets

U.S. PATENT DOCUMENTS

| | | | | |
|---|---|---|---|---|
| 6,742,951 | B2 | 6/2004 | Schultz et al. | |
| 6,868,989 | B2 | 3/2005 | Fahy et al. | |
| 6,872,021 | B1 | 3/2005 | Wilson et al. | |
| 6,889,917 | B2 | 5/2005 | Fahy et al. | |
| 6,953,299 | B2 | 10/2005 | Wang et al. | |
| 6,990,705 | B1 | 1/2006 | Schouten et al. | |
| 7,000,282 | B2 * | 2/2006 | Cox et al. | 15/245 |
| 7,467,438 | B2 * | 12/2008 | Ryman | 15/244.3 |
| 2005/0039293 | A1 | 2/2005 | McReynolds et al. | |
| 2006/0048319 | A1 | 3/2006 | Morgan et al. | |

FOREIGN PATENT DOCUMENTS

| | | | |
|---|---|---|---|
| DE | 7638436 | U1 | 8/1977 |
| DE | 8910266 | U1 | 10/1989 |
| DE | 202004009880 | U1 | 9/2004 |
| GB | 2125689 | A | 3/1984 |
| GB | 2414654 | A | 12/2005 |
| JP | 2004166837 | A | 6/2004 |
| WO | WO 2005084717 | A | 9/2005 |

* cited by examiner

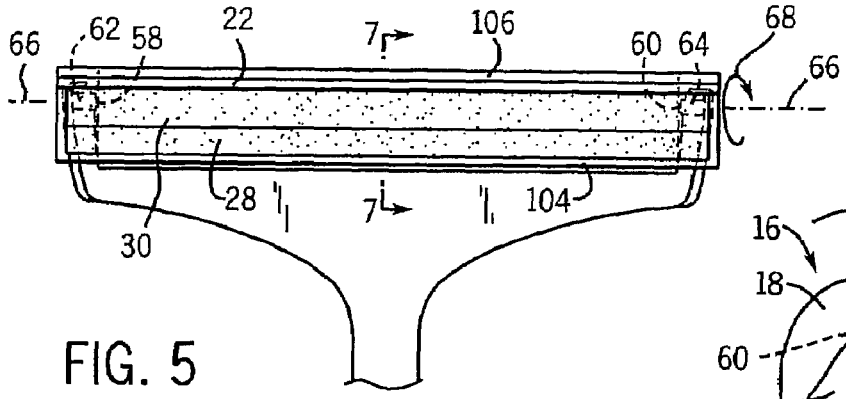
FIG. 5
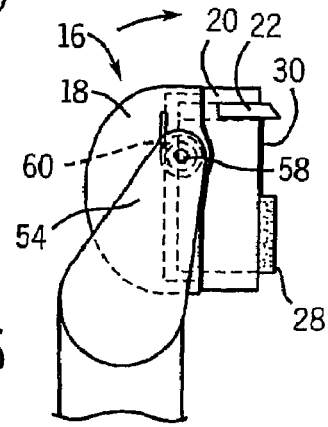
FIG. 6
FIG. 7
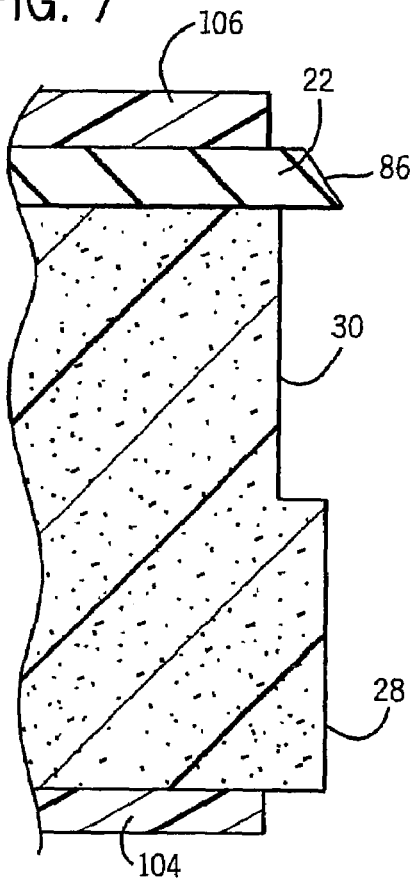
FIG. 8
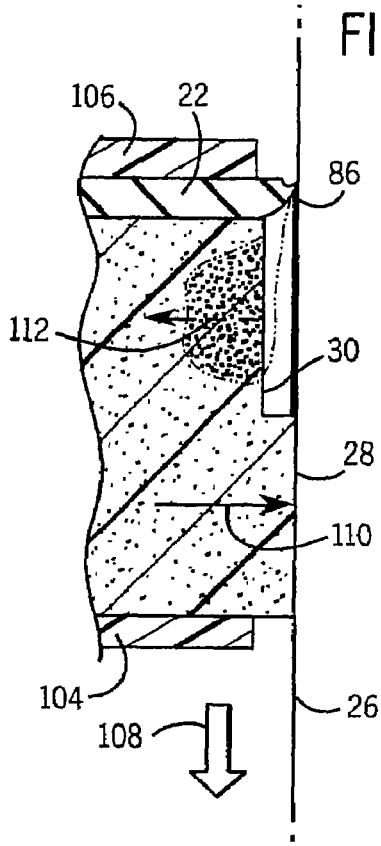

CLEANING IMPLEMENT

CROSS-REFERENCE TO RELATED APPLICATIONS

This application claims priority based on U.S. provisional applications 60/784,540, filed Mar. 22, 2006, and 60/844,868, filed Sep. 15, 2006.

STATEMENT REGARDING FEDERALLY SPONSORED RESEARCH/DEVELOPMENT

Not applicable.

BACKGROUND OF THE INVENTION

The present invention relates to devices for cleaning windows and other hard surfaces. More particularly, it relates to "all-in-one" type devices that deliver a cleaning fluid, work the fluid along the surface being cleaned, squeegee the used liquid off the surface, and collect the used liquid.

Cleaning of windows and other hard surfaces typically requires several tools and is a multi-step process. One typically picks up a spray bottle and sprays the window, then picks up a sponge or cloth and works the cleaning fluid along the window glass, then picks up a squeegee to drive the used cleaning fluid off the window, then dries the remaining "drool" with a rag or the like. Hence, several devices are required, and additional time is needed to shift from device to device. Moreover, this process may leave wet and soiled paper or rags to be dealt with or disposed of.

There have been attempts to collect liquid as it is being squeegeed off windows or other surfaces, using wicking or absorbent layers adjacent the squeegee blade. See e.g., U. S. Pat. Nos. 5,970,560, 6,092,255 and 6,668,418. Even when using such devices one will still need to use a separate spray bottle.

While there have been a variety of attempts to incorporate a source of cleaning fluid into a cleaning device (see e.g. U.S. Pat. No. 6,872,021), most of these devices do not provide the capability for collecting the squeegee "drool". While this is not a serious problem for automobile use, or for use on the outside of buildings, use on the interior surfaces of building windows can be problematic, particularly where sensitive paint or flooring is adjacent the window being cleaned.

U.S. Pat. No. 1,376,195 discloses a window cleaning device in which there is a reservoir containing cleaning liquid that impregnates a moistening element/sponge. Adjacent to that is a squeegee which collects the liquid and drives it to an adjacent catch reservoir on the device. Similarly, U.S. Pat. No. 2,722,701 discloses a device which supplies a cleaning liquid, squeegees it off the window, and collects at least some of it in an adjoining absorbent pad region. However, with these devices, once the liquid is used up or the collection capacity of the device exceeded, it is difficult to adapt the device for continued use. Moreover, the devices are not compact and carry unnecessary weight.

While replaceable cartridges have been used in a variety of contexts (e.g. U.S. Pat. No. 5,092,669), there is still a need for a compact, replaceable refill element that both delivers cleaning fluid and absorbs it in the context of a cleaning implement of the all-in-one type.

BRIEF SUMMARY OF THE INVENTION

The present invention relates to a cleaning implement for cleaning a surface. It has a support head mounting a squeegee blade and a substrate structure. The substrate structure is impregnated with a cleaning fluid and is suitable to deliver cleaning fluid to the surface as well as to collect used cleaning fluid driven by the squeegee blade off the surface. The squeegee blade and a portion of the substrate structure are capable of simultaneously touching the surface as it is cleaned.

In preferred embodiments the substrate structure and the squeegee blade are both removably mountable to the support head, the support head is pivotably linked to a handle, and there is a spring linked to the handle and support head to control pivotal movement of the support head (to improve positioning of the blade relative to the substrate and glass, and to equalize pressure.

The substrate structure can be formed from a single block, albeit it may alternatively be of several pieces. Most preferred for the substrate structure are polyester fiber materials, polypropylene fiber materials, cellulose acetate fiber materials, and bonded polyolefin fiber materials available from Filtrona Richmond Inc. (Colonial Heights, Va.)(e.g. BFP or BNW grades). Also preferred are porous polyethylene or polyvinylacetate material available from Porex, or a cellulosic pad with horizontal capillary fibers made of plastic to improve integrity and water transport. Another possibility is to use a melamine foam.

In other preferred forms the substrate structure has a portion suitable to face the surface being cleaned, where that portion has an inset area or step adjacent to the squeegee blade to facilitate collecting used cleaning fluid, and an outwardly extending portion more remote from the squeegee blade suitable to contact the surface being cleaned. The squeegee blade is attached to the support head and the substrate structure may be removable from the support head while the squeegee blade remains linked to the support head. Such a device can be used for cleaning windows by applying a window cleaner.

In another aspect the invention provides a refill kit for an implement suitable to treat a hard surface. It has a squeegee blade mounted to an anchor, the anchor being suitable to mount the blade to the implement, and a porous substrate impregnated with a window cleaner, the porous substrate being suitable to deliver the window cleaner to the hard surface as well as to collect used window cleaner.

The squeegee blade can be wider than the porous substrate, and the porous substrate can have a portion suitable to face the surface being treated, where that portion has an inset area to facilitate collecting used window cleaner and has an outwardly extending portion suitable to contact the surface being treated.

In another aspect the invention provides a method of cleaning a hard surface with a tool. One applies liquid stored in the tool to the surface, squeegees the liquid off the surface using the tool, and then absorbs the squeegeed liquid from the surface into a porous absorbent of the tool. The applying, squeegeeing and absorbing steps can be achieved via a single downward stroke of the tool along the hard surface. For example the hard surface can be a window and the liquid can be a window cleaner.

Particularly desirable is that the substrate structure have a portion designed to face the surface being cleaned, where that facing portion has an inset adjacent to a squeegee blade to facilitate collecting used cleaning fluid, and an outwardly extending portion suitable to contact the surface being cleaned (to apply and work in the cleaning liquid). This helps avoid leaving dirtied cleaning liquid on the glass or other hard surface.

In some forms the squeegee blade is retained with the substrate structure in a single replaceable cartridge unit. Alternatively and preferably, the squeegee blade can be separately mounted to the support head and the substrate structure can be removable from the support head while the squeegee blade remains on the support head. This permits the substrate to be replaced more frequently than the squeegee blade, recognizing that cleaning liquid is typically used up from a substrate more quickly than a squeegee blade wears out.

The substrate can be stored for sale in a hermetically sealed pouch. Once the pouch is opened, the substrate structure is installed on the tool, and then may be covered until cleaning is to begin (or between uses). This inhibits the cleaning fluid from evaporating from the substrate structure.

Such devices are most suitable for cleaning building windows. However, they can also be used for cleaning automobile windows and other hard surfaces such as those found in bathing and showering areas or on counter tops. A variety of cleaning liquids can be used ranging from water to specialized window cleaners (e.g. Windex® brand window cleaner), to other hard surface cleaning fluids.

When the substrate structure is a single piece it can deliver the cleaning fluid to the window, and then also absorb the cleaning fluid back into itself. Surprisingly, this form of substrate structure can also act as a filter to reprocess the cleaning fluid so that it can to some extent then be used again. Hence, the amount of impregnating fluid, and thus the weight of the device, can be kept to a minimum.

Even when the substrate structure is a multiple piece structure (e.g. one material to absorb and another or more of the same material to deliver), windows can be cleaned without the need for a separate spray bottle, or other separate drying cloths or squeegees.

In addition to cleaning, the liquid impregnating the substrate structure could also treat the surface in other ways. For example, the liquid could contain polishes, antibacterial treatments and/or insecticides.

A handle can be elongated by flipping out a lower handle part relative to the upper handle part, preferably with an automatic latch that engages when this occurs. Either handle part may also have a hole through it to facilitate hanging of the device on a nail or other hanger between uses.

The foregoing and other advantages of the invention will become apparent from the following description. In the following description reference is made to the accompanying drawings which form a part thereof, and in which there is shown by way of non-limiting illustration preferred embodiments of the invention.

BRIEF DESCRIPTION OF THE DRAWINGS

FIG. 5 is a front elevational view of the structure shown in FIG. 2;

FIG. 6 is a left side elevational view of a portion of the FIG. 1 assembly;

FIG. 7 is a partial vertical sectional view taken along line 7-7 of FIG. 5;

FIG. 8 is a view similar to FIG. 7, but taken along line 8-8 of FIG. 1, and with the device being rubbed against a window;

DETAILED DESCRIPTION OF THE PREFERRED EMBODIMENTS

Figure 1:
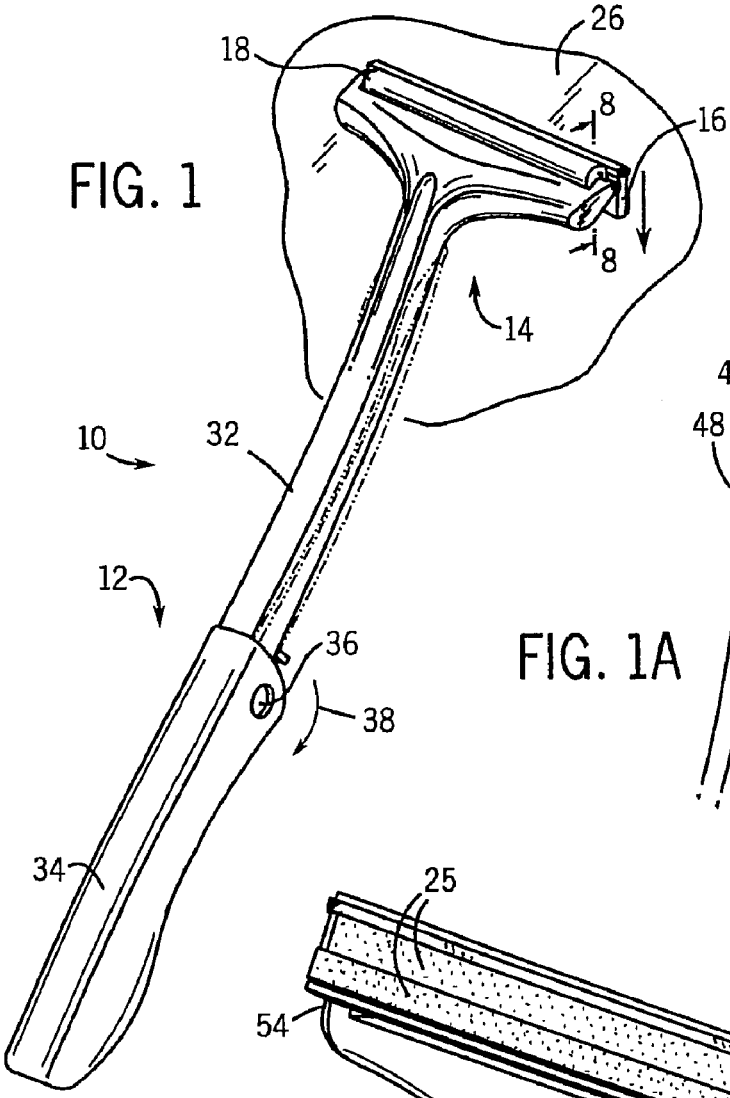
FIG. 1 is a rear perspective view of a cleaning (or other surface treating) implement of the present invention.

Referring first to FIGS. 1-4 there is shown a cleaning device 10 of the present invention having a handle 12 linked to a support head 14. A replaceable cartridge 16 is mountable on the support head via a pivotable holder 18.

The cartridge 16 has an outer rear shell 20, a squeegee blade 22 positionable inside and at an upper end of the shell, and an absorbent substrate structure 24 positionable below the squeegee blade in the shell 20. In a preferred embodiment the substrate structure is essentially a 215 cm×20 cm×13 cm block of Filtrona brand plastic fiber material. That substrate structure is then impregnated with 20 ml of a window cleaner such as Windex® brand window cleaner.

Preferably the handle 12 is formed of two segments 32 and 34 that are pivotally connected (36) near adjacent ends of the segments. Thus, the segment 34 can be flipped out following the direction of arrow 38 to obtain a longer effective handle. Alternatively, the segments can be pivoted into overlapping configuration for easy storage and transportation.

Figure 1A:
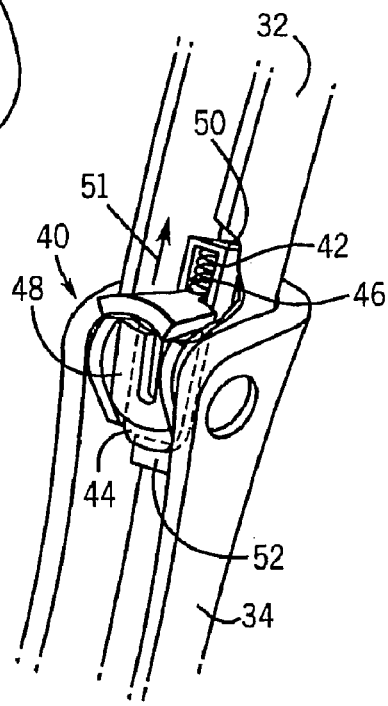
FIG. 1A is an enlarged frontal perspective view of a latching portion of the handle structure.
Figure 2:
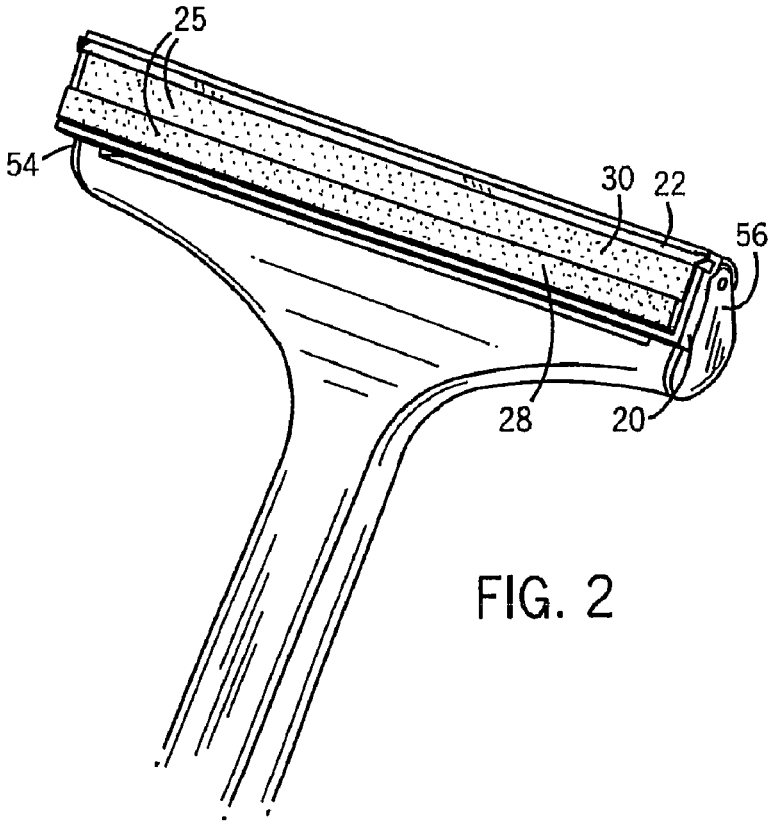
FIG. 2 is a frontal perspective view of the support head portion, and part of the handle structure, of the FIG. 1 cleaning implement.

FIG. 1A shows that the segment 32 may have a spring-biased latch 40 that has a spring 42 and a lever 44 operably connected to the spring. The segment 32 may also have a groove 46 and a cross plate 48. The spring 42 sits in the groove 46 and is anchored to a back wall 50 and the cross plate 48 holds the lever 44 as well as the spring 42 in place. When the segment 34 is flipped out, the spring 42 pushes the lever 44 to sit on top a seat 52 of the segment 34, locking the segments 32 and 34 in an unfolded, elongated position. A user can push the lever 44 in the opposite direction 51 to unseat the lever and the segment 34 can be flipped back towards the segment 32 and the two segments may then be locked in a folded position via a snap together connection (not shown).

Figure 3:
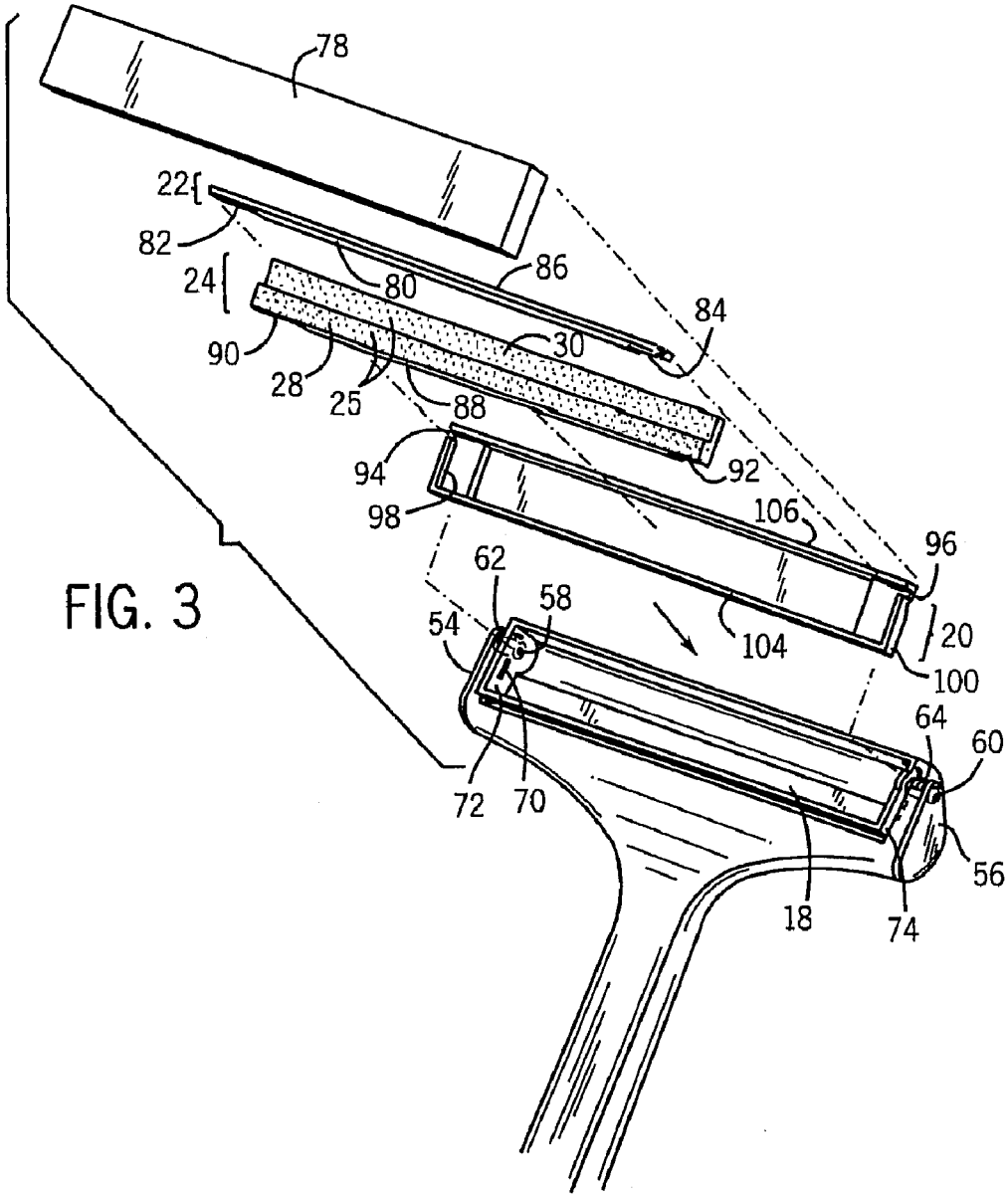
FIG. 3 is an exploded view of the FIG. 2 structure.

Referring primarily to FIGS. 3, 5 and 6, the holder 18 is pivotally mounted to a pair of fingers 54 and 56 extended from the support head 14 by two spring-loaded pins 58 and 60 through two holes on the holder and two holes on the fingers. One end of each of pin springs 62 and 64 is held in the holder 18 and the other in an orifice in the fingers 54 and 56. The holder 18, and in consequence the cartridge 16 when mounted to the holder 18, can rotate around axis 66 (FIG. 5). The springs 62 and 64 provide resistance to rotation in the direction of 68 (FIG. 5) to facilitate the pressing and downward dragging of the squeegee blade 22 and the substrate structure 24. The holder 18 may have a pocket 70 on the inner side of wall 72 (FIG. 3) and a similar pocket (not shown) on the inner side of wall 74 for forming snap connection in a removable fashion with the cartridge 16 via two prongs on the cartridge (FIG. 4, prong 76 and a similar prong (not shown) on the opposite side of the cartridge).

The cartridge 16 may also have a cover 78 to cover the substrate structure 24 when not in use to prevent the substrate structure from drying out. An old cartridge 16 can be replaced by a new one after the substrate structure 24 has run its useable life.

The squeegee blade 22 is in the shape of a "T" with a short, fat trunk 80, two short arms 82 and 84, and an edge 86 (FIG. 3). The squeegee blade can be made of a conventional rubber. However, the specific squeegee material is not critical.

The porous, absorbent substrate structure 24 may have a fat trunk 88 and two short arms 90 and 92 (FIG. 3). A top surface 25 of the substrate structure 24 may be uneven with a portion 28 elevated over inset 30 (FIGS. 3 and 7). As shown in FIG. 7, the absorbent can have an L-shape in cross section wherein the blade can be generally slab-like with a tapered end. Still other cross sectional shapes are possible such as a cross shape.

The substrate structure 24 must have sufficient integrity so that when it is pressed and dragged against a window, the portion 28 remains outwardly extended relative to the adjacent inset portion. The substrate structure material be of sufficient abrasiveness or roughness for the purpose of scrubbing the surface being cleaned.

The shell 20 has an inside space tracking the general shape of the squeegee blade 22 and the substrate structure 24 so that the squeegee blade and the substrate structure can be fitted into the shell 20 and held therein (compare FIGS. 3 and 8). The shell 20 also has two slots 94 and 96 on side walls 98 and 100 into which the squeegee blade arms 82 and 84 can extend so that the shell can accept a squeegee blade with longer arms than the substrate structure 24. The longer arms on the squeegee blade can help reduce or eliminate drooling of the cleaning liquid delivered by the substrate structure 24.

The substrate structure 24 and squeegee blade 22 may be dimensioned to fit tightly in the shell 20 so as to be securely held in the shell by frictional force. Alternatively, the squeegee blade and the substrate structure may be glued or bolted to the shell. When not in use, the cartridge 16 is removably capped by the cover 78 to prevent the surface treating liquid from evaporating from the substrate structure 24.

Figure 4:
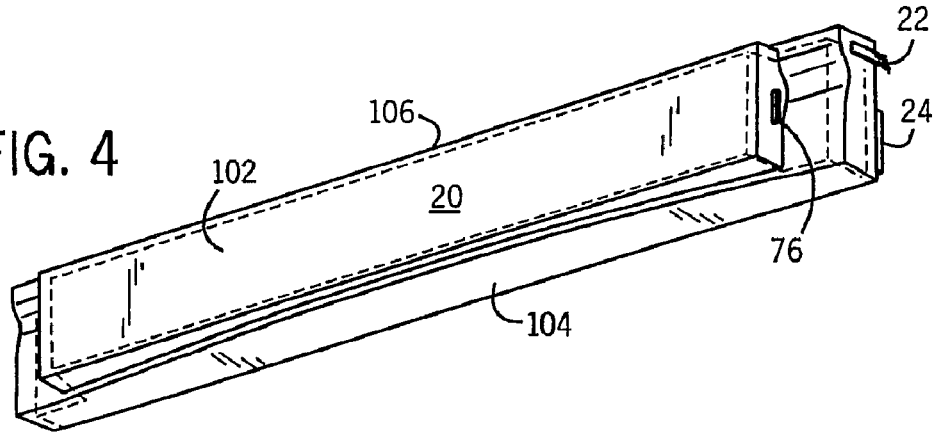
FIG. 4 is an enlarged rear perspective view of a first refill of the present invention.

On the outside, the shell 20 has a smaller bottom 102 for mounting the cartridge 16 to the holder 18 (FIG. 4). Walls 104 and 106 of the shell 20 are thinner at the bottom 102 allowing the formation of the smaller bottom on these two sides without sacrificing the corresponding inside space. The smaller bottom allows the cartridge 16 to be mounted to a smaller holder 18, making the cleaning implement more compact.

As will be apparent from FIG. 8, the substrate structure 24 is formed with an inset 30 at its upper end. When the substrate structure 24 and the squeegee blade 22 are pressed against a window/surface 26, lower portion 28 of the substrate structure 24 delivers the cleaning liquid to the window being cleaned and also helps work in the liquid against dirt and other materials on the window. The squeegee will then drive the used cleaning liquid off the window into the gap formed between the window 26 and the inset 30, followed by the used liquid being absorbed back into the substrate structure 24 adjacent inset 30. When the absorbent is one piece, the used cleaning fluid may then at least partially be filtered by the substrate structure 24, and then caused to move back to the applicator region by gravity and wicking.

The substrate structure portion 28 and the blade edge 86 of the squeegee blade 22 are pressed against a window 26 and dragged downward in the direction of arrow 108. Impregnated window cleaning liquid is delivered from the substrate structure portion 28 to the window 26 (see arrow 110). As the substrate structure portion 28 and the blade edge 86 are dragged down while being pressed against the window 26 in a single stroke, the substrate structure portion 28 scrubs the window surface to help remove stains and other deposits, and the blade edge 86 scrapes the soiled/used liquid off the window, which is in turn collected and absorbed by the substrate structure adjacent the inset 30 of the substrate structure 24 (see arrow 112).

As the edge 86 of the squeegee blade extends beyond the length of the substrate structure 24 (see FIGS. 2 and 5), leaving streaks on the window is avoided. After the substrate structure 24 has run its useable life, a new cartridge 16 is installed to replace the old one.

A window can be cleaned and dried without needing any other tool or element. The device provides its own supply of cleaning liquid, provides scrubbing, provides a way to squeegee the used fluid off the window to dry it, and provides a way to collect the fluid that is being squeegeed off. The implement is designed so that saturation of an absorbent with used cleaning fluid is unlikely to be the critical limiting factor for the useful life. In this regard, the refreshed previously used liquid can be re-used.

Figure 9:
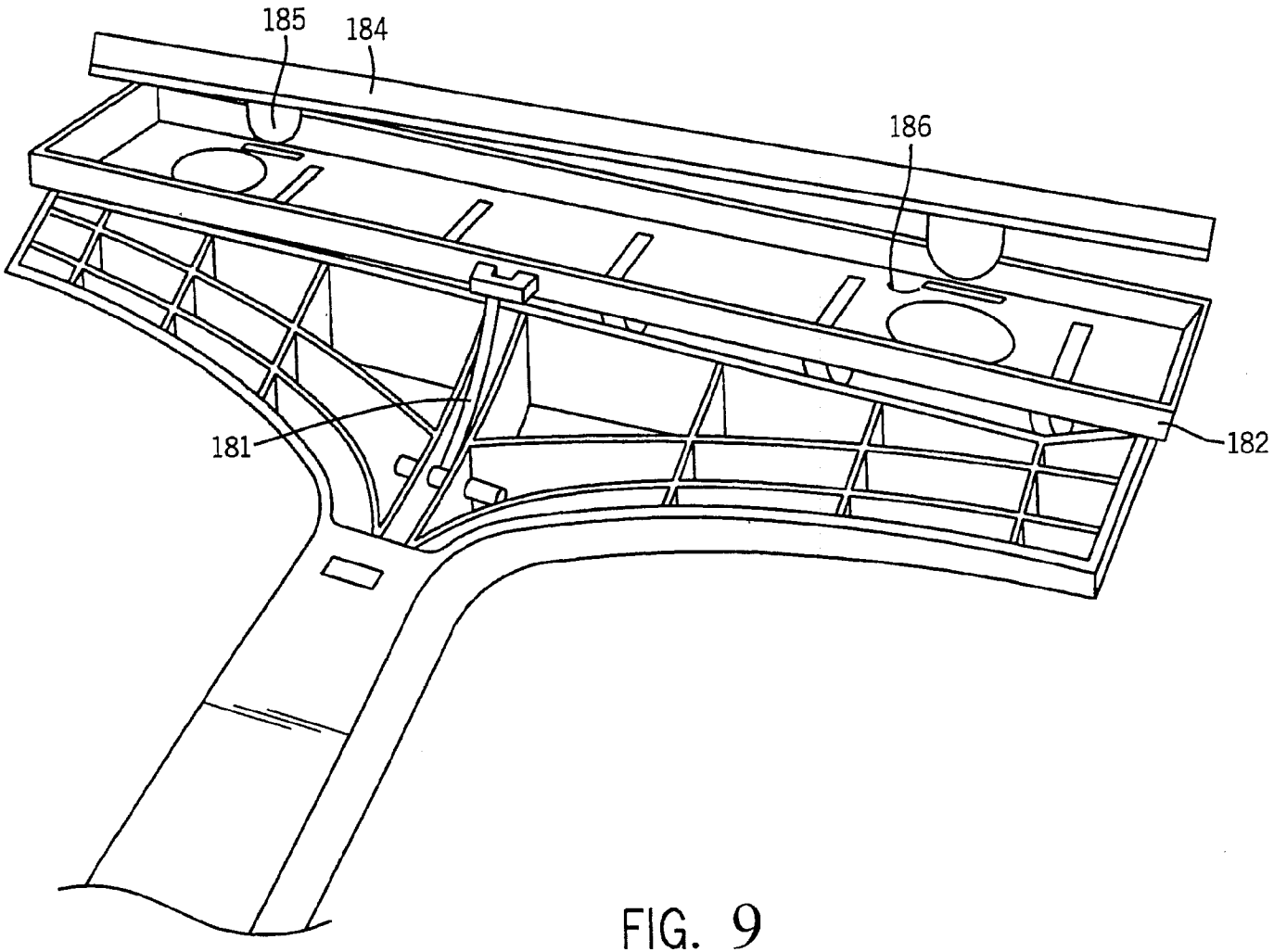
FIG. 9 is a perspective view of an alternative, more preferred, embodiment where a squeegee blade is in the process of being installed.

It is highly desirable to control the positioning of the blade relative to the surface being cleaned, the pressure distribution across the cleaning head, and the interrelationship between the blade, absorbent and step. For example, there is disclosed another embodiment in FIGS. 9 and 10 where there is provided a spring 181 to control the position of the pivoting member 182. This embodiment provides a head that pivots relative to the handle so that more pressure is placed on the blade than the substrate. This helps insure that the substrate almost floats across the glass surface. The pivot point 183 is closer to the blade 184 than the center point of the pivoting member 182.

The blade 184 is mounted on an anchor 185 whose feet wedge into slots 186. The substrate 120 can be separately replaced without changing the blade 184. In this embodiment there is no extra casing or shell like that of shell 20 in FIG. 3.

The step/inset should be deep enough to create a pool into which squeegeed liquid can be channeled while awaiting re-absorption. Too deep a step permits too much liquid to collect, and hence results in residual liquid on the glass as the liquid waiting to re-absorb will contact the glass. Too shallow a step won't allow a sufficient temporary "home" for the liquid, and thus also result in residual liquid on the glass.

While preferred embodiments of the present invention have been described and otherwise disclosed herein, still other alternative embodiments are also intended to be within the scope of the claims. For example, while a single block substrate structure is preferred, the substrate structure could instead be a two-part structure, divided by a wall. In that configuration the portion of the substrate structure adjacent the blade could be a collector, and the portion in the other part of the structure could be an applicator. In this structure the reprocessing function would not be taken advantage of.

Figure 10:
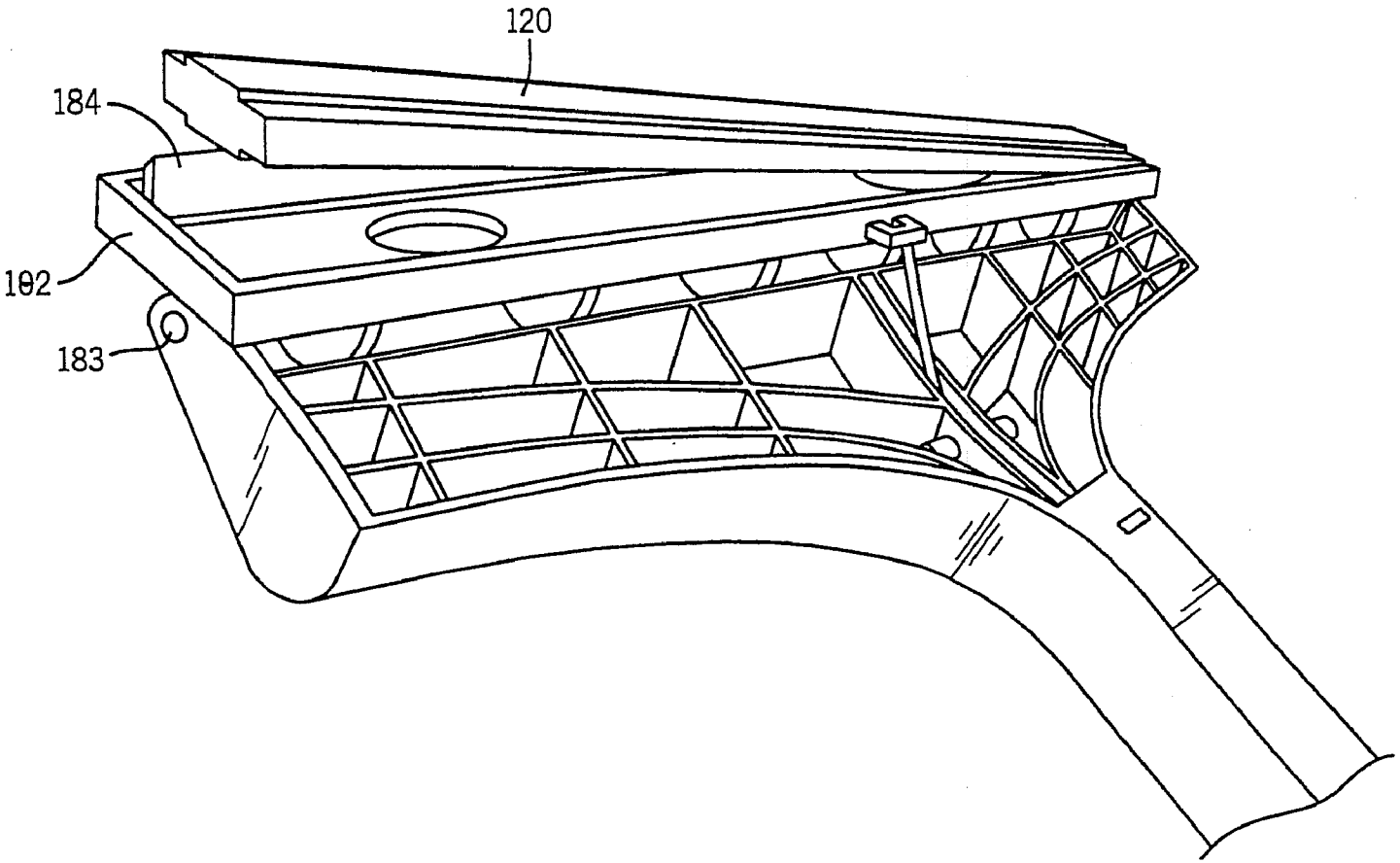
FIG. 10 is another perspective view of the FIG. 9 embodiment, but with the squeegee blade already installed, and with a substrate structure in the process of being installed.

Other contemplated modifications are:

(a) the FIG. 10 holes at the back of pivoting member 182 could be covered by living hinge controlled panels. Thus, instead of a consumer directly pushing a finger through those holes to pop out the substrate 120, the finger would push against a living hinge panel which would then pivot to push against the substrate 120, to pop it out when the substrate needs to be replaced. This would avoid having a consumer directly contact the used substrate during this replacement process;

(b) the packaging for replacement substrates 120 could be configured to also act as a cover between uses after the substrate has been installed on pivoting member 182;

(c) the refill substrate 120 can be provided with vertical grooves along its peripheral sides which align with projections on the pivoting member 182 for greater stability;

(d) the refill substrate 120 can be provided with a horizontal groove along its long sides to receive a projection from the squeegee blade to facilitate aligning the two relative to each other;

(e) the anchors 185 can be made with projections so as to snap fit into holes 186, rather than just being frictionally engaged;

(f) the blade and anchor subassembly can be made non-symmetrical forward-to-back, to insure proper positioning of the pointed end of the squeegee relative to the substrate 120; and/or (g) the back of the pivoting member 182 can have multiple rearwardly projecting legs that run along spaced support platforms on the support head so that forces transmitted along the device as it is pressed against a window or the like don't cause the substrate to buckle.

Still other modifications are possible within the scope and spirit of the invention. Thus, claims should be looked to in order to judge the full scope of the invention.

INDUSTRIAL APPLICABILITY

The present invention provides all-in-one cleaning devices for cleaning windows and other surfaces, as well as refill kits for use therewith, and methods for using such devices.

What is claimed is:

1. A cleaning implement for cleaning a window, comprising:

a support head mounting a squeegee blade and a substrate structure;

wherein the substrate structure is impregnated with a window cleaner and suitable to deliver window cleaner to the window as well as to collect used window cleaner driven by the squeegee blade off the window;

wherein the squeegee blade and a portion of the substrate structure are capable of simultaneously touching the window as it is cleaned;

wherein the substrate structure has a portion suitable to face the window being cleaned, where that portion has an inset area sufficiently adjacent to the squeegee blade to facilitate collecting pooled window cleaner in the inset area that has been driven off the window before it is re-absorbed into the substrate, and an outwardly extending area more remote from the squeegee blade suitable to contact the window being cleaned, wherein the inset area helps define an open gap that is in part also defined by the squeegee blade; and wherein the substrate structure is in the form of a filter is made of a fibrous porous absorbent material that filters at least a portion of collected used window cleaner when the cleaning implement is used, and then delivers that filtered window cleaner back to a window being cleaned.

2. The cleaning implement of claim 1, wherein the substrate structure and the squeegee blade are both removably mountable to the support head.

3. The cleaning implement of claim 1, wherein the support head is pivotably linked to a handle.

4. The cleaning implement of claim 3, wherein a spring linked to the handle and support head controls pivotal movement of the support head.

5. The cleaning implement of claim 1, wherein the substrate structure comprises a porous absorbent material which is a fibrous material selected from the group consisting of polyester fiber, polypropylene fiber, cellulose acetate fiber, and bonded polyolefin fiber.

6. The cleaning implement of claim 1, wherein the squeegee blade is attached to the support head and the substrate structure is removable from the support head while the squeegee blade remains on the support head.

7. A refill kit for an implement suitable to treat a hard surface of a window, comprising:

a squeegee blade mounted to an anchor, the anchor being suitable to mount the blade to the implement; and a porous substrate impregnated with a window cleaner, the porous substrate being suitable to deliver the window cleaner to the hard surface of the window as well as to collect used window cleaner;

wherein the porous substrate is in the form of a filter that filters at least a portion of collected used window cleaner when the implement is used, and then delivers that filtered window cleaner back to a window being cleaned;

wherein the substrate structure has a portion suitable to face the window being cleaned, where that portion has an inset area positionable sufficiently adjacent to the squeegee blade to facilitate collecting pooled window cleaner that has been driven off the window into the inset area before it is re-absorbed into the substrate, and an outwardly extending area more remote from the squeegee blade suitable to contact the window being cleaned, wherein the inset area helps define an open gap that is in part also defined by the squeegee blade; and wherein the porous substrate comprises a porous absorbent material comprising a fibrous material selected from the group consisting of polyester fiber, polypropylene fiber, cellulose acetate fiber, and bonded polyolefin fiber.

8. The refill kit of claim 7, wherein the squeegee blade is wider than the porous substrate.

9. A method of cleaning a hard surface of a window with a tool, the method comprising:

applying liquid window cleaner stored in the tool to the surface;

squeegeeing the liquid off the surface using the tool;

absorbing squeegeed liquid from the surface into a porous absorbent of the tool; and filtering absorbed squeegeed liquid and then delivering at least a portion of the filtered liquid to the surface;

wherein the applying, squeegeeing and absorbing steps can be achieved via a single downward stroke of the tool along the hard surface;

wherein the tool comprises:

a support head mounting a squeegee blade and a substrate structure;

wherein the substrate structure is impregnated with the liquid and is suitable to deliver the liquid to the surface as well as to collect used liquid driven by the squeegee blade off the surface and filter the used liquid;

wherein the substrate structure has a portion suitable to face the window being cleaned, where that portion has an inset area sufficiently adjacent to the squeegee blade to facilitate collecting pooled window cleaner that has been driven off the window in the inset area before it is re-absorbed into the substrate, and an outwardly extending area more remote from the squeegee blade suitable to contact the window being cleaned, wherein the inset area helps define an open gap that is in part also defined by the squeegee blade; and wherein the squeegee blade and the outwardly extending portion of the substrate structure are capable of simultaneously touching the surface as it is cleaned.

* * * * *